US007037135B2

(12) United States Patent
Chen et al.

(10) Patent No.: US 7,037,135 B2
(45) Date of Patent: May 2, 2006

(54) DOUBLE SHIELDED ELECTRICAL CONNECTOR

(75) Inventors: Wei-Xing Chen, Kunsan (CN); Quan Zhuang, KUnsan (CN); Ning Wang, Kunsan (CN); Zhi-Qiang Chen, Tu-Chen (TW); Ya-Lei Xue, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/998,855

(22) Filed: Nov. 29, 2004

(65) Prior Publication Data

US 2005/0124218 A1 Jun. 9, 2005

(30) Foreign Application Priority Data

Dec. 3, 2003 (CN) ..... 200320120260X

(51) Int. Cl.
*H01R 13/648* (2006.01)

(52) U.S. Cl. ..... 439/607

(58) Field of Classification Search ..... 439/607, 439/351, 355, 350, 352, 353, 357
See application file for complete search history.

(56) References Cited

U.S. PATENT DOCUMENTS

| | | | | |
|---|---|---|---|---|
| 5,437,563 | A * | 8/1995 | Kihira et al. | 439/607 |
| 6,053,773 | A * | 4/2000 | Wu | 439/609 |
| 6,139,350 | A | 10/2000 | Mathesius | |
| 6,171,148 | B1 | 1/2001 | Chiu et al. | |
| 6,280,209 | B1 | 8/2001 | Bassler et al. | |
| 6,346,009 | B1 * | 2/2002 | Lin | 439/607 |
| 6,379,184 | B1 * | 4/2002 | Bassler et al. | 439/607 |
| 6,533,612 | B1 * | 3/2003 | Lee et al. | 439/607 |
| 6,722,919 | B1 * | 4/2004 | Lin | 439/607 |
| 6,793,531 | B1 * | 9/2004 | Zhang | 439/607 |

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector (1) has an insulative housing (10), a plurality of contacts (20) received in the housing, an inner shell (30) surrounding the housing and an outer shell (40) surrounding the inner shell. The connector has a plurality of tabs (251, 263) extending inwardly therefrom. The tabs are constructed in the cover and bottom of the inner shell and can be latched to a mating connector. The out shell is conjoint to and overlaps the inner shell.

18 Claims, 4 Drawing Sheets

DOUBLE SHIELDED ELECTRICAL CONNECTOR

BACKGROUND OF THE INVENTION

1. Field of the Invention

The present invention generally relates to an electrical connector, and particularly relates to a power connector mounting on a printed circuit board.

2. Description of Prior Arts

U.S. Pat. No. 6,139,350 discloses a shelled plug-in connector has an insulative housing, which, in the plug-in region, is constructed as a plastic tongue with an essentially rectangular cross-section. The connector has a shroud surrounding the tongue. The connector has two pairs of latching hooks with the hooks of each pair being alongside each other and being offset inwards, which hooks are constructed in the cover and bottom of the shroud and can be latched into recesses of a screening housing of a plugged-in mating connector. The upper side of the plastic tongue has two depressions, into which in each case one of the two upper latching hooks penetrates from above.

Obviously, the latching hooks of the shroud result in two pairs of openings opened therein, which not only weaken the shroud integrity but further make the electrical connector fragile.

Hence, it is desirable to have an improved electrical connector to overcome the above-mentioned disadvantages of the prior art.

SUMMARY OF THE INVENTION

It is an object of the present invention to provide an electrical connector having an enhanced shroud.

In order to achieve the above-mentioned object, an electrical connector in accordance with the present invention has an insulative housing, a plurality of contacts received in the housing, an inner shell surrounding the housing and an outer shell surrounding the inner shell. The connector has a plurality of tabs extending inwardly, which are constructed in the cover and bottom of the inner shell and can be latched to a mating connector. The outer shell is conjoint to the inner shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
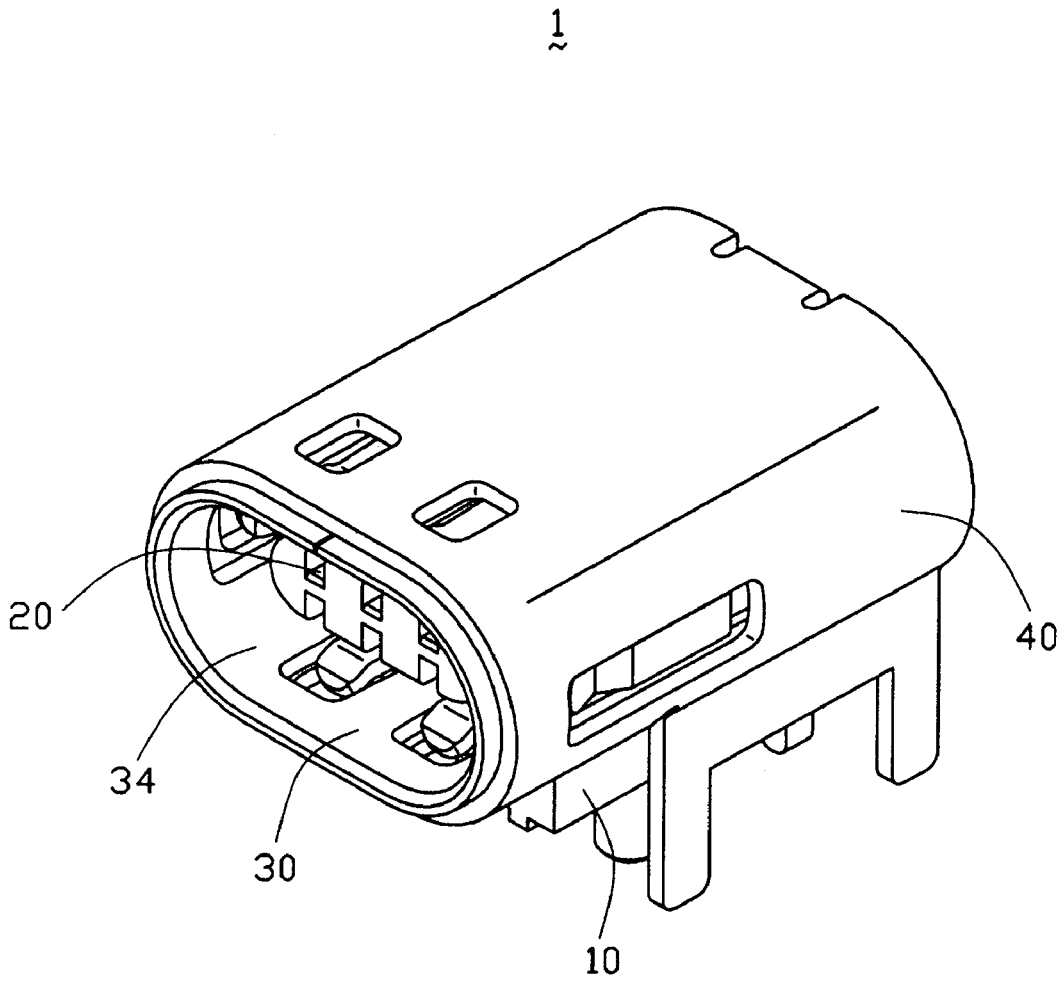
FIG. 1 is a perspective view of an electrical connector in accordance with the present invention.

Reference will now be made to the drawing figures to describe the present invention in detail.

Figure 2:
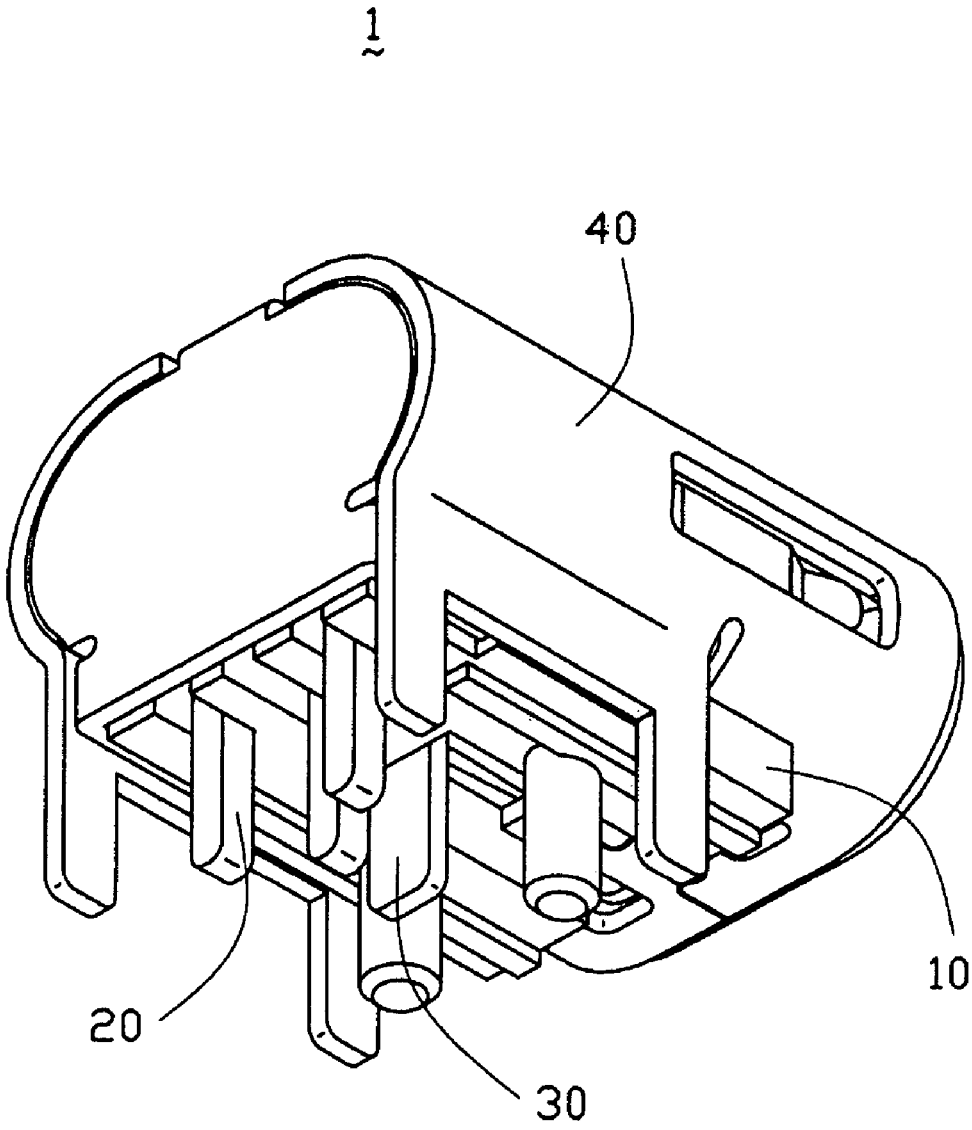
FIG. 2 is a view similar to FIG. 1, but taken from a different perspective.
Figure 3:
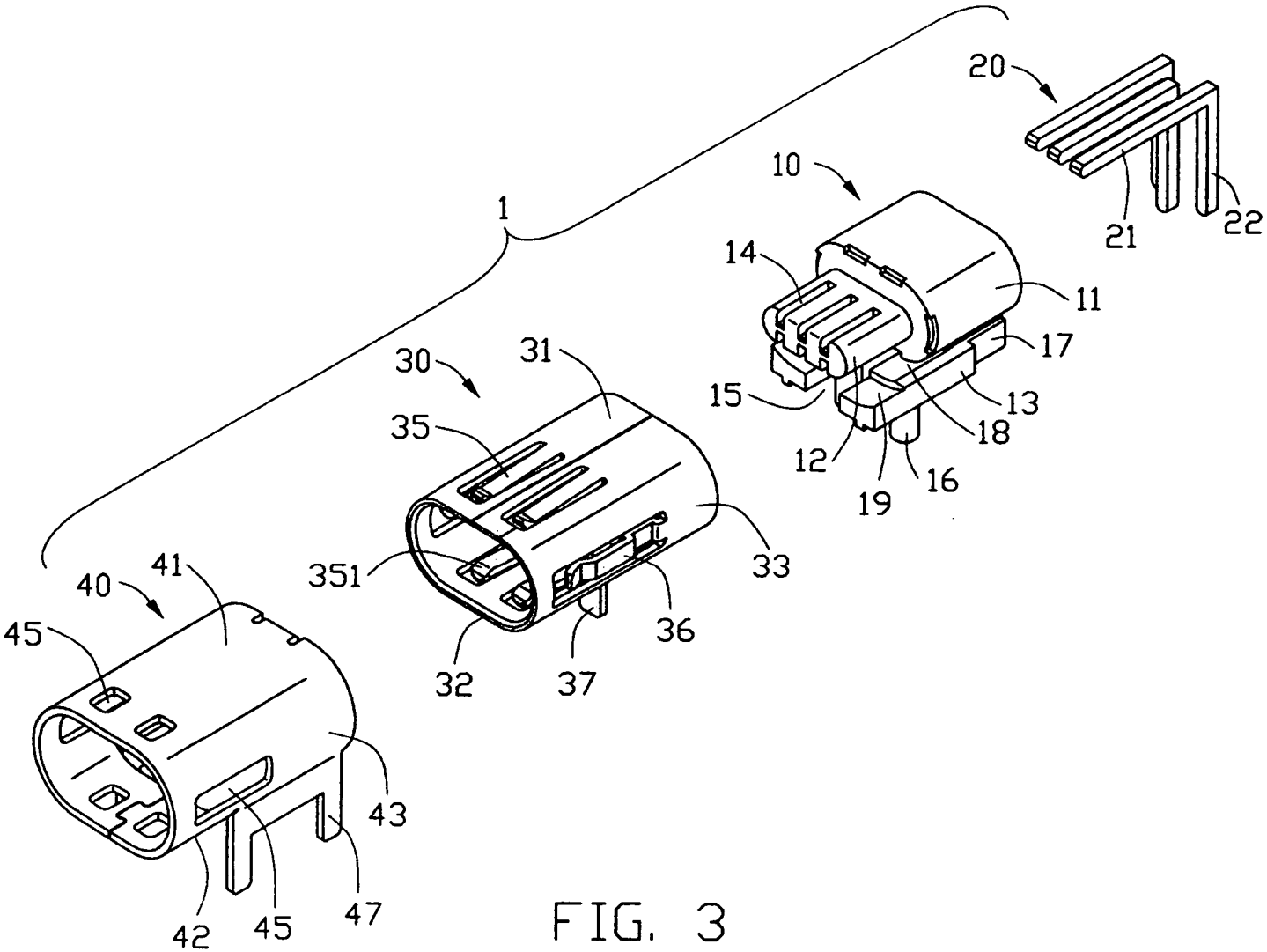
FIG. 3 is an exploded, perspective view of the electrical connector of FIG. 1.
Figure 4:
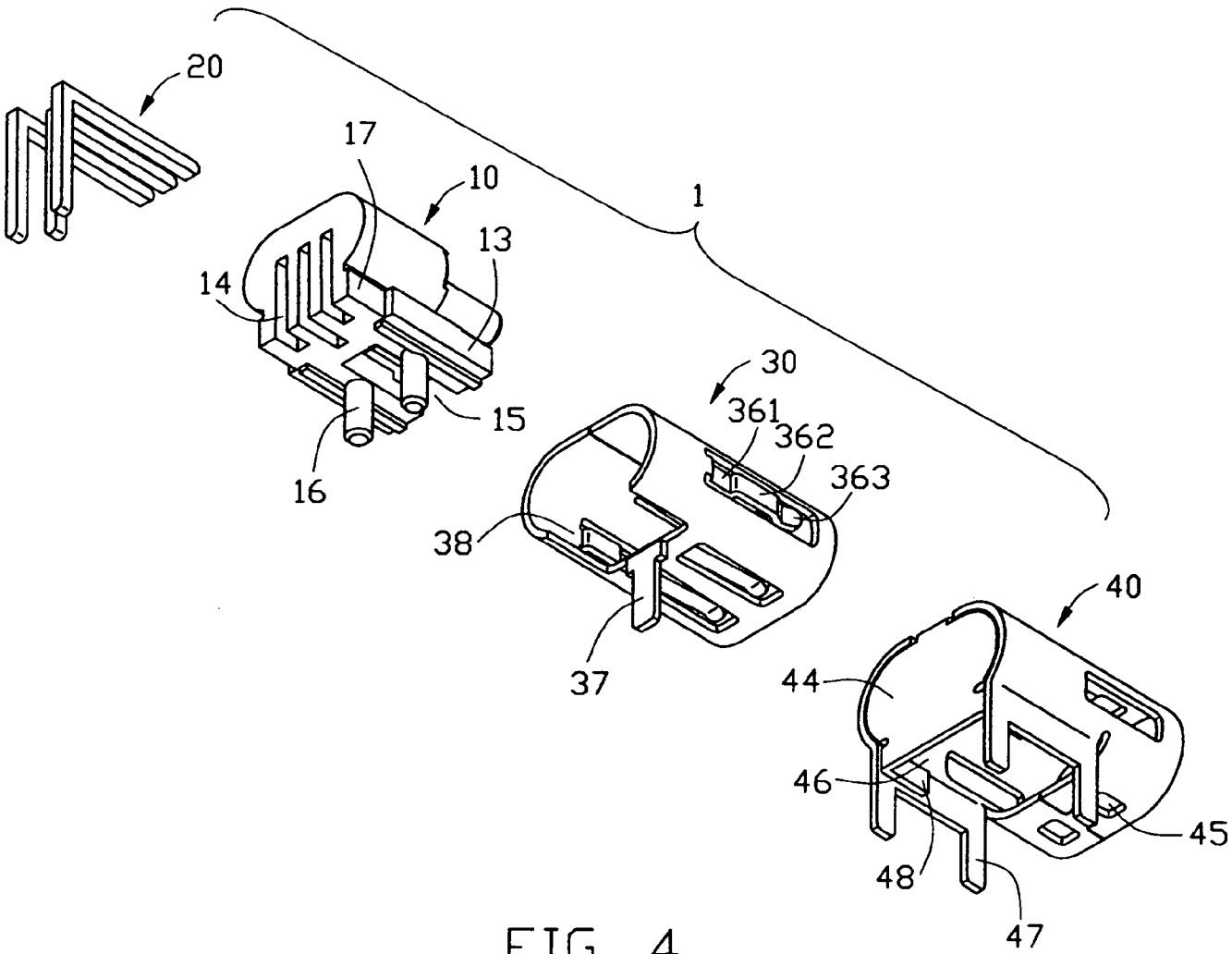
FIG. 4 is a view similar to FIG. 3, but taken from a different perspective.

With reference to FIGS. 1 to 4, an electrical connector in accordance with the present invention is a power jack connector 1 mounting on a printed circuit board (not shown) and comprises an insulating housing 10, a plurality of contacts 20, an inner shell 30 and an outer shell 40.

The insulative housing 10 comprises a base portion 11 with an approximately elliptic cross-section, a tongue portion 12 with an approximately elliptic cross-section extending forwardly from the base portion 11 and a mounting portion 13 extending downwardly from the base portion 11. A plurality of passageways 14 extend through the base portion 11 along a longitudinal direction, and through the tongue portion 12 and the mounting portion 13 along a vertical direction. The mounting portion 13 comprises a recess 15 defined on a front end thereof, a pair of engaging portions 17 defined on opposite sides of a rear end thereof, two board retaining posts 16 extending downwardly therefrom, and a pair of step-shaped retaining sections 19 defined on opposite sides of the recess 15. A groove 18 is defined between the base portion 11 and the mounting portion 13.

The contacts 20 are L-shaped and received in the passageways 14 of the housing 10. Each contact 20 defines a mating portion 21 and a terminating portion 22.

The inner shell 30 surrounds the housing 10 and conjoints to the base portion 11 of the housing 10, and comprises a cover 31, a bottom 32 and a pair of sides 33 connecting the cover 31 and the bottom 32. A receiving space 34 is defined between the inner shell 30 and the received tongue portion 12. A plurality of first tabs 35 extend from the cover 31 and bottom 32 into the receiving space 34. Each first tab 35 defines a contacting section 351 on a free end thereof. A pair of S-shaped second tabs 36 extend from the sides 33 into the receiving space 34. Each second tab 36 comprises a first curved section 361 extending inwardly, a second curved section 362 extending outwardly and a contacting section 363 defined on a free end thereof. The bottom 32 further comprises a board retaining leg 37 extending downwardly and a recess 38 defined on a front end thereof.

The outer shell 40 substantially encloses and conjoints to the inner shell 30 and comprises a cover 41, a bottom 42, a pair of sides 43 connecting with the cover 41 and the bottom 42, and a rear 44 connecting the cover 41. A plurality of openings 45 are defined on the outer shell at the corresponding positions of the first and second tabs 35, 36. A pair of engaging arms 48 are formed on opposite sides of the lower edge of the rear 44 and abut against inner sides of the outer shell 40. A plurality of board retaining legs 47 extend downwardly from the sides 43. A recess 46 is defined on a front end of the bottom 42.

In assembly, the contacts 20 are inserted into the passageways 14 from the rear end of the housing 10 with the terminating portions 22 extending out of the housing 10. The base portion 11 of the housing 10 is assembled into the inner shell 30 in a rear-to-front direction. The edge of the recess 38 of the inner shell 30 is received in the groove 18, and the board retaining leg 37 is received in the recess 15. The first curved sections 361 of the second tabs 36 abut against the base portion 11 of the housing 10. The outer shell 40 is assembled to the inner shell 30, with the edge of the recess 46 being retained between the bottom 32 of the inner shell 30 and the step-shaped retaining sections 19 of the housing 10. The rear 44 covers the rear end of the housing 10 and the inner shell 30. The engaging arms 48 mate with the engaging portions 17 for retaining the out shell 40. The board retaining posts 16, the terminating portions 22 of the contacts and the board retaining legs 37, 47 of the inner and out shells 30, 40 all connect with the printed circuit board.

In use, the mating complementary connecter (not shown) is received in the receiving space 34 and the contacting sections 351, 363 of the first and second tabs 35, 36 are respectively latched to the complementary connector for providing a retaining force, which are deformed and extend into the openings 45 of the outer shell 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector mounting on a printed circuit board comprising:

an insulative housing;

a plurality of contacts received in the housing;

an inner shell surrounding the insulative housing to define a receiving space therebetween, the inner shell having a plurality of tabs extending into the receiving space; and an outer shell substantially enclosing and electrically connecting with the inner shell;

the outer shell defines a plurality of openings at positions corresponding to the tabs of the inner shell.

2. The electrical connector as described in claim 1, wherein outside surface of the inner shell substantially abuts against inside surface of the outer shell.

3. The electrical connector as described in claim 1, wherein the housing comprises a base portion and a tongue portion extending from the base portion, the tongue portion defining a plurality of passageway's receiving the contacts.

4. The electrical connector as described in claim 3, wherein the outer shell defines a pair of engaging arms extending from opposite sides thereof and wherein the housing defines a pair of engaging sections mating with the engaging arms.

5. The electrical connector as disclosed in claim 1, wherein the inner shell comprises a cover and a bottom opposite to the cover, and the tabs comprise a plurality of first tabs extending from the cover and the bottom of the inner shell, respectively, each first tab defines a contacting section.

6. The electrical connector as described in claim 5, wherein the tabs comprise a pair of second tabs extending from the opposite sides of the inner shell, each second tab defining a first curved section abutting against the housing, a contacting section and a second curved section connecting the first curved section and the contacting section.

7. The electrical connector as described in claim 6, wherein the inner and outer shells each define a recess communicating with each other.

8. The electrical connector as described in claim 7, wherein the inner and outer shells respectively define at least one board retaining leg connecting with the printed circuit board.

9. The electrical connector as described in claim 8, wherein the housing defines a base portion and a mounting portion extending from the base portion and through the recesses of the inner and outer shells to be mounted on the printed circuit board.

10. The electrical connector as described in claim 9, wherein the housing defines a groove between the mounting portion and the base portion of the housing, and edges of the recess of the inner shell are received in the groove.

11. The electrical connector as described in claim 10, wherein the mounting portion defines a pair of retaining sections on the front end thereof, and the edge of the recess of the outer shell is retained between the retaining section and the inner shell.

12. An electrical connector mounting on a printed circuit board comprising:

an insulating housing;

a plurality of contacts received in the housing;

an inner metallic shell attached to the insulating housing to define a receiving space therebetween, the inner shell having a plurality of tabs stamped therefrom and extending inwardly into the receiving space; and an outer metallic shell surrounding at least a portion of the inner shell in an intimate contact relation therewith for reinforcement;

wherein the outer metallic shell and the inner metallic shell have similar cross-sectional configuration around the receiving space wherein;

said outer shell defines openings in alignment with said tabs to allow outward movement of said tabs.

13. The connector as claimed in claim 12, wherein both said inner shell and said outer shell includes mounting legs.

14. The connector as claimed in claim 13, wherein the mounting leg of the inner shell and that of the outer shell are not aligned with each other in a front-to-back direction.

15. The electrical connector as described in claim 12, wherein the housing comprises a base portion and the mounting portion extending downwardly from the base portion.

16. The electrical connector as described in claim 15, wherein the mounting portion is formed with a pair of board retaining posts extending downwardly therefrom.

17. A method of making an electrical connector comprising:

providing an insulative housing with a plurality of conductive contacts; providing an inner metallic shell with a receiving space wherein a plurality of tabs stamped from the inner shell and extending into the receiving space; attaching said inner shell to the housing;

attaching an outer metallic shell to the inner shell circumferentially in an intimate contact relation to reinforce strength of said inner shell; wherein the outer metallic shell and the inner metallic shell have a similar cross-sectional configuration around receiving space;

wherein said outer shell is equipped with a plurality of openings in alignment with said tabs respectively to allow the corresponding tabs to extend outwardly when a complementary connector is inserted into the receiving space.

18. The method of claim 17, wherein said outer shell and said inner shell both have mounting legs for mounting to a printed circuit board on which the housing is seated.

* * * * *